US010506841B2

(12) United States Patent
Bologna et al.

(10) Patent No.: US 10,506,841 B2
(45) **Date of Patent: *Dec. 17, 2019**

(54) FOOTBALL HELMET WITH RECESSED FACE GUARD MOUNTING AREAS

(71) Applicant: Riddell, Inc., Rosemont, IL (US)

(72) Inventors: Vittorio Bologna, Elk Grove Village, IL (US); Nelson Kraemer, Mount Prospect, IL (US); Thad M. Ide, Chicago, IL (US)

(73) Assignee: Riddell, Inc., Des Plaines, IL (US)

( * ) Notice: Subject to any disclaimer, the term of this patent is extended or adjusted under 35 U.S.C. 154(b) by 0 days.

This patent is subject to a terminal disclaimer.

(21) Appl. No.: 15/467,410

(22) Filed: Mar. 23, 2017

(65) Prior Publication Data

US 2017/0189787 A1 Jul. 6, 2017

Related U.S. Application Data

(63) Continuation of application No. 14/179,360, filed on Feb. 12, 2014, now Pat. No. 9,656,148.

(60) Provisional application No. 61/763,802, filed on Feb. 12, 2013.

(51) Int. Cl.

| | |
|---|---|
| ***A63B 71/10*** | (2006.01) |
| ***A42B 3/06*** | (2006.01) |
| ***A42B 3/12*** | (2006.01) |
| ***A42B 3/16*** | (2006.01) |
| ***A42B 3/20*** | (2006.01) |
| ***A42B 3/28*** | (2006.01) |
| ***A42B 3/08*** | (2006.01) |
| ***A42B 3/32*** | (2006.01) |

(52) U.S. Cl.

CPC ..... *A42B 3/20* (2013.01); *A42B 3/062* (2013.01); *A42B 3/068* (2013.01); *A42B 3/08* (2013.01); *A42B 3/125* (2013.01); *A42B 3/128* (2013.01); *A42B 3/16* (2013.01); *A42B 3/205* (2013.01); *A42B 3/283* (2013.01); *A42B 3/326* (2013.01); *A63B 71/10* (2013.01)

(58) Field of Classification Search

CPC ..... A43B 3/062; A43B 3/125; A43B 3/16; A43B 3/205; A43B 3/283; A43B 3/326; A43B 3/20; A43B 3/06; A63B 71/10

USPC ..... 2/424, 410, 425, 9

See application file for complete search history.

(56) References Cited

U.S. PATENT DOCUMENTS

| | | | |
|---|---|---|---|
| 2,890,457 | A | 6/1959 | Marietta |
| 3,039,109 | A | 6/1962 | Simpson |
| 3,116,490 | A | 1/1964 | Zbikowski |

(Continued)

FOREIGN PATENT DOCUMENTS

| | | |
|---|---|---|
| JP | H07126908 | 5/1995 |
| JP | 2001020121 | 1/2001 |

*Primary Examiner* — Jameson D Collier
*Assistant Examiner* — Heather N Mangine
(74) *Attorney, Agent, or Firm* — Barnes & Thornburg LLP

(57) ABSTRACT

A protective football helmet is provided having a face guard mounting system with at least one pair of opposed recessed mounting regions that ensure a low-profile mounting arrangement for a face guard to the helmet. The recessed mounting regions are formed in both the inner and outer surfaces of the helmet shell along a frontal opening in the shell. As a result of the streamlined frontal appearance provided by the face guard mounting system, the width of the face guard closely corresponds to the width of the helmet at the recessed mounting regions.

27 Claims, 12 Drawing Sheets

(56) References Cited

U.S. PATENT DOCUMENTS

| | | | | |
|---|---|---|---|---|
| 3,153,792 | A | 10/1964 | Marietta | |
| 3,155,981 | A | 11/1964 | Mckissick | |
| 3,197,784 | A | 8/1965 | Carlisle | |
| 3,344,433 | A | 10/1967 | Stapenhill | |
| 3,373,443 | A | 3/1968 | Marietta | |
| 3,447,163 | A | 6/1969 | Bothwell | |
| 3,582,990 | A | 6/1971 | Frieder | |
| 4,028,743 | A | 6/1977 | Christensen | |
| 4,134,155 | A | 1/1979 | Robertson | |
| 4,136,403 | A | 1/1979 | Walther | |
| 4,168,542 | A | 9/1979 | Small | |
| 4,223,409 | A | 9/1980 | Lee | |
| 4,239,106 | A | 12/1980 | Ailed | |
| 4,432,099 | A | 2/1984 | Grick | |
| 4,466,138 | A | 8/1984 | Gessalin | |
| 4,586,200 | A | 5/1986 | Poon | |
| 4,937,888 | A | 7/1990 | Straus | |
| 5,101,517 | A | 4/1992 | Douglas | |
| 5,298,208 | A | 3/1994 | Sibley | |
| 5,475,878 | A | 12/1995 | Dawn | |
| 5,517,691 | A | 5/1996 | Blake | |
| 5,539,936 | A | 7/1996 | Thomas | |
| 5,561,866 | A | 10/1996 | Ross | |
| 5,787,513 | A | 8/1998 | Sharmat | |
| 5,794,271 | A | 8/1998 | Hastings | |
| 5,950,243 | A | 9/1999 | Winters | |
| 5,966,744 | A | 10/1999 | Smith, Jr. | |
| 6,154,889 | A | 12/2000 | Moore et al. | |
| 6,298,483 | B1 | 10/2001 | Schiebl | |
| 6,314,586 | B1 | 11/2001 | Duguid | |
| 6,378,140 | B1 | 4/2002 | Abraham | |
| D495,838 | S | 9/2004 | Michio | |
| 7,328,462 | B1 * | 2/2008 | Straus | A42B 3/067 2/411 |
| D587,852 | S | 3/2009 | Nimmons | |
| D616,154 | S | 5/2010 | Daniel | |
| 7,802,320 | B2 | 9/2010 | Morgan | |
| D625,050 | S | 10/2010 | Chen | |
| D633,658 | S | 3/2011 | Daniel | |
| 8,069,498 | B2 | 12/2011 | Maddux | |
| 8,176,574 | B2 | 5/2012 | Bryant | |
| 8,209,784 | B2 | 7/2012 | Nimmons et al. | |
| D681,280 | S | 4/2013 | Ide | |
| D681,281 | S | 4/2013 | Bologna | |
| 8,499,366 | B2 | 8/2013 | Nimmons et al. | |
| 8,544,118 | B2 | 10/2013 | Brine, III | |
| 8,572,767 | B2 | 11/2013 | Bryant | |
| 8,756,719 | B2 | 6/2014 | Veazie | |
| 8,776,272 | B1 | 7/2014 | Straus | |
| 8,966,671 | B2 | 3/2015 | Rumbaugh | |
| 9,332,800 | B2 | 5/2016 | Brown | |
| 9,498,014 | B2 | 11/2016 | Wingo | |
| 9,750,296 | B2 | 9/2017 | Knight | |
| 9,763,488 | B2 | 9/2017 | Bologna | |
| 10,130,133 | B2 | 11/2018 | Leon | |
| 10,149,511 | B2 | 12/2018 | Vito | |
| 2001/0039674 | A1 | 11/2001 | Shida | |
| 2005/0241049 | A1 | 11/2005 | Ambuske | |
| 2007/0000032 | A1 | 1/2007 | Morgan | |
| 2007/0094769 | A1 | 5/2007 | Lakes | |
| 2007/0119538 | A1 | 5/2007 | Price | |
| 2007/0266471 | A1 | 11/2007 | Lin | |
| 2007/0266481 | A1 | 11/2007 | Alexander | |
| 2008/0163410 | A1 | 7/2008 | Udelhofen | |
| 2009/0031479 | A1 | 2/2009 | Rush, III | |
| 2009/0038055 | A1 | 2/2009 | Ferrara | |
| 2009/0044316 | A1 | 2/2009 | Udelhofen | |
| 2009/0106882 | A1 * | 4/2009 | Nimmons | A42B 3/20 2/414 |
| 2010/0050323 | A1 | 3/2010 | Durocher | |
| 2010/0299813 | A1 | 12/2010 | Morgan | |
| 2011/0047678 | A1 | 3/2011 | Barth | |
| 2011/0271428 | A1 | 11/2011 | Withnall | |
| 2012/0017358 | A1 | 1/2012 | Princip | |
| 2012/0233745 | A1 | 9/2012 | Veazie | |
| 2012/0317705 | A1 | 12/2012 | Lindsay | |
| 2013/0014313 | A1 | 1/2013 | Erb | |
| 2013/0061371 | A1 | 3/2013 | Phipps | |
| 2013/0067643 | A1 | 3/2013 | Musal | |
| 2013/0185837 | A1 | 7/2013 | Phipps | |
| 2013/0283504 | A1 | 10/2013 | Harris | |
| 2013/0333098 | A1 | 12/2013 | Nimmons et al. | |
| 2014/0007322 | A1 | 1/2014 | Marz | |
| 2014/0101829 | A1 | 4/2014 | Witcher | |
| 2015/0335091 | A1 | 11/2015 | Erb | |
| 2015/0335092 | A1 | 11/2015 | Erb | |
| 2017/0065018 | A1 | 3/2017 | Lindsay | |

* cited by examiner

-Prior Art-

-Prior Art-

-Prior Art-

FOOTBALL HELMET WITH RECESSED FACE GUARD MOUNTING AREAS

CROSS-REFERENCE TO RELATED APPLICATIONS

This Application is a continuation of pending U.S. patent application Ser. No. 14/179,360 entitled "FOOTBALL HELMET WITH RECESSED FACE GUARD MOUNTING AREAS," filed on Feb. 12, 2014, which claims the benefit of U.S. Provisional Patent Application Ser. No. 61/763,802 entitled "PROTECTIVE SPORTS HELMET WITH ENGINEERED ENERGY DISPERSION SYSTEM," filed on Feb. 12, 2013, the disclosures of which are hereby incorporated by reference in their entirety for all purposes.

TECHNICAL FIELD

The invention relates to a protective football helmet that features a low-profile mounting configuration for a face guard that protects the player's facial area. The helmet includes an outer shell with recessed frontal mounting areas that ensure a low-profile connection of the face guard to the helmet.

BACKGROUND OF THE INVENTION

Protective helmets for contact sports, such as those used in football, hockey and lacrosse, typically include a rigid outer shell, an internal pad assembly coupled to an interior surface of the shell, a face guard or face mask, and a chin protector or strap that removably secures the helmet on the wearer's head. The face guard covers a front opening of the helmet shell and protects the wearer's facial area. Conventional face guards are formed from a plurality of intersecting elongated bars that define apertures through which the wearer looks through while participating in the contact sport. The face guard is secured to the helmet by connectors and brackets that fasten to the outer surface of the helmet shell. In this manner, the face guard resides external to and outside of the helmet shell.

In the last decade, the overall size of conventional protective helmets, including the helmet shell, has increased in an effort to improve the helmet's performance and impact performance. As the helmet size increases, the frontal profile of these helmets has also increased. The frontal profile is further increased when the face guard is secured to the helmet shell. The resulting frontal profile of the helmet and the face guard connected thereto can be visually dominant and unappealing to wearers of the helmet, as well as potential wearers of the helmet.

Features and advantages of the invention will be apparent to those skilled in the art upon review of the following detailed description and accompanying drawings.

SUMMARY OF THE INVENTION

The invention provides a football helmet having a low-profile face guard mounting configuration that provides a streamlined frontal appearance. The helmet includes a one-piece shell having a crown portion defining an upper region of the shell, a front portion extending generally forwardly and downwardly from the crown portion, left and right side portions extending generally downwardly and laterally from the crown portion. The front portion and the left and ride side portions collectively define a frontal opening in the shell, wherein the front opening includes opposed peripheral frontal edges. A lower recessed face guard attachment region extends along a lower extent of the opposed peripheral frontal edges and an upper recessed face guard attachment region extends along an upper extent of the opposed peripheral frontal edges. A face guard has opposed lower peripheral portions and opposed upper peripheral portions. To provide the low-profile face guard mounting configuration, the lower peripheral portions are secured to the lower recessed attachment regions by lower connector brackets and the upper peripheral portions are secured to the upper recessed attachment regions by upper connector brackets.

BRIEF DESCRIPTION OF THE DRAWINGS

The drawing figures depict one or more implementations in accord with the present teachings, by way of example only, not by way of limitation. In the figures, like reference numerals refer to the same or similar elements.

DETAILED DESCRIPTION

Figure 1:
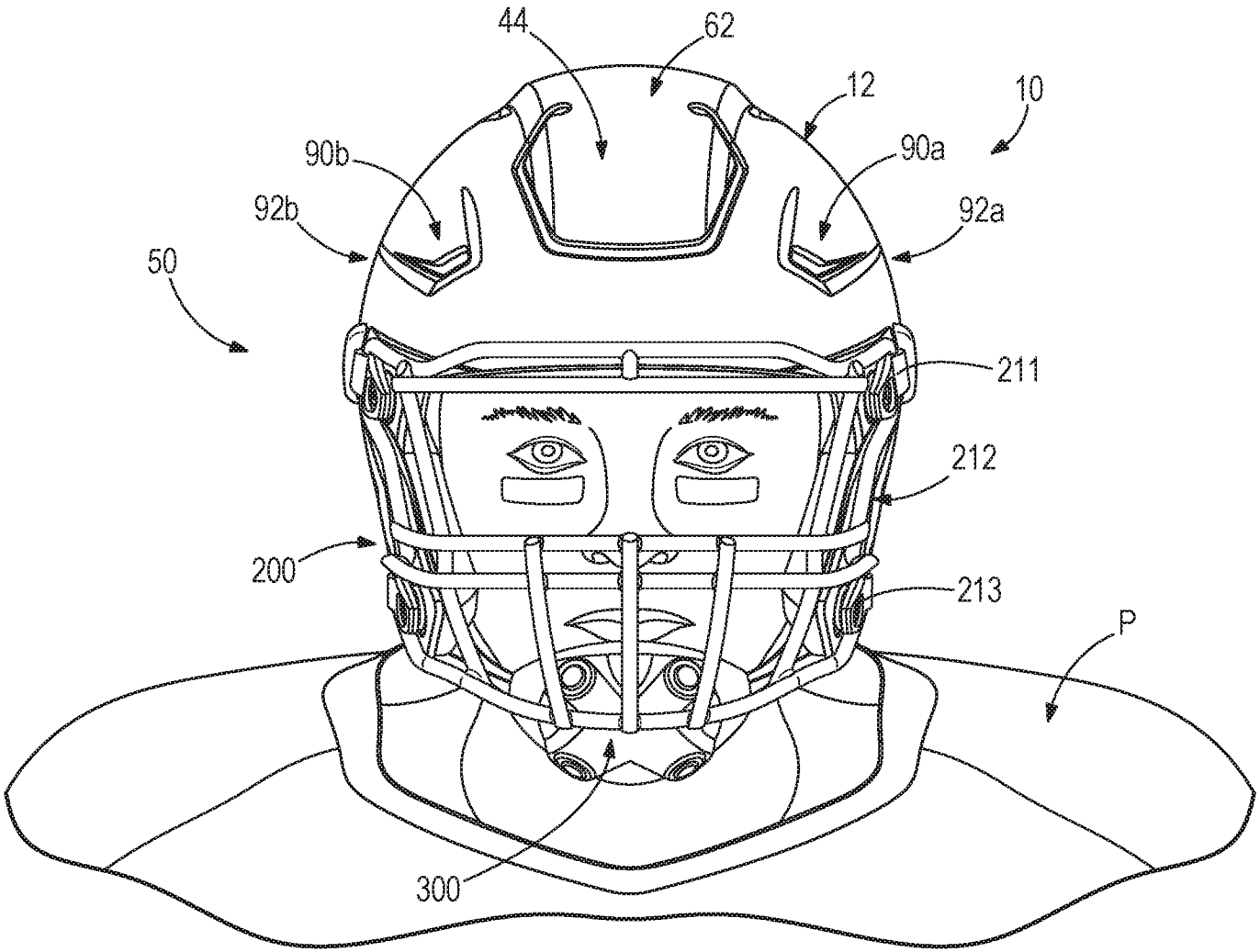
FIG. 1 is a front view of a football helmet of the invention, the helmet being worn by a player.

While this invention is susceptible of embodiments in many different forms, there is shown in the drawings and will herein be described in detail preferred embodiments of the invention with the understanding that the present disclosure is to be considered as an exemplification of the principles of the invention and is not intended to limit the broad aspect of the invention to the embodiments illustrated.

FIGS. 1-15 illustrate a football helmet 10 with a durable, one-piece molded shell 12 that includes a face guard mounting system 50 featuring recessed mounting areas 54, 56 that ensure a low-profile connection of the face guard 200 to the helmet 10. This low-profile connection arrangement results in a streamlined, low-profile frontal appearance of the helmet 10. In particular, FIGS. 1, 2, 3A, 6 and 11-15 show the face guard 200 connected to the helmet 10 in the low-profile configuration. As a result of streamlined frontal appearance provided by the face guard mounting system 50, the width of the face guard 200 closely corresponds to the width of the helmet 10 at the recessed mounting areas 54, 56. It is understood by those of skill in the art of designing protective sports helmets that different regions of a football helmet experience impacts of different types, magnitudes and durations during the course of playing the particular sport. It is also understood that the types, magnitudes and durations of impact forces upon a helmet are different in football, hockey and lacrosse because these sports differ in many significant ways, e.g., the underlying nature of the play, the number and type of players, the equipment worn by the players, and the playing surface. It is further understood that while playing football, a player may experience multiple impacts to the same or different regions of the helmet during a single play or a series of plays.

FIG. 1 shows the helmet 10 being worn by a wearer or player P. In addition to the face guard mounting system 50, the helmet 10 includes the shell 12, the facemask or face guard 200 attached at upper and lower frontal regions of the shell 12 by removable upper and lower connectors 211, 213. The face guard 200 comprises an arrangement of elongated and intersecting bar members 212 and is designed to span a frontal opening 14 in the shell 12 to protect the facial area and chin of the player P. The one-piece, molded (either injection or thermoformed) shell 12 is formed from impact resistant plastic or polymer materials, such as polycarbonate, acrylonitrile butadiene styrene (ABS), or nylon. The helmet 10 also includes a chin strap assembly 300 and an internal pad assembly 400 (see FIGS. 1, 2 and 14) that is detailed below.

As shown in the Figures, the shell 12 includes a curvilinear outer surface 16 featuring complex contours and facets. The shell 12 also includes a crown portion 18 defining a top region of the helmet 10, a front portion 20 extending generally forwardly and downwardly from the crown portion 18, left and right side portions 24 extending generally downwardly and laterally from the crown portion 18, and a rear portion 22 extending generally rearwardly and downwardly from the crown portion 18. The left and right side portions 24 each include an ear flap 26 positioned generally to overlie and protect the ear region of the player P when the helmet 10 is worn. Each ear flap 26 may be provided with an ear hole 30, which may have a non-circular configuration, to improve hearing for the wearer. The shell 12 is symmetric along a vertical plane dividing the shell 12 into left and right halves. When the helmet 10 is worn by the player P (see FIG. 1), this vertical plane is aligned with the midsagittal plane that divides the player P (including his or her head) into symmetric right and left halves. Therefore, features shown in Figures as appearing in one half of the shell 12 are also present in the other half of the shell 12. The helmet also has an engineered impact attenuation system that includes an impact attenuation member 42 which adjusts how the portion of the helmet 10 including the member 42 responds to impact forces compared to adjacent portions of the helmet 10 lacking the member 42. The impact attenuation member 42 is formed by altering at least one portion of the shell 12 wherein that alteration changes the configuration of the shell 12 and its local response to impact forces applied substantially normal to the front shell portion 20. For example, in the illustrated configuration, the impact attenuation member 42 includes a cantilevered segment or flap 44 formed in the front shell portion 20. Compared to the adjacent portions of the shell 12 that lack the cantilevered segment 44, the cantilevered segment 44 improves the attenuation of energy associated with impacts to at least the front shell portion 20.

Figure 3A:
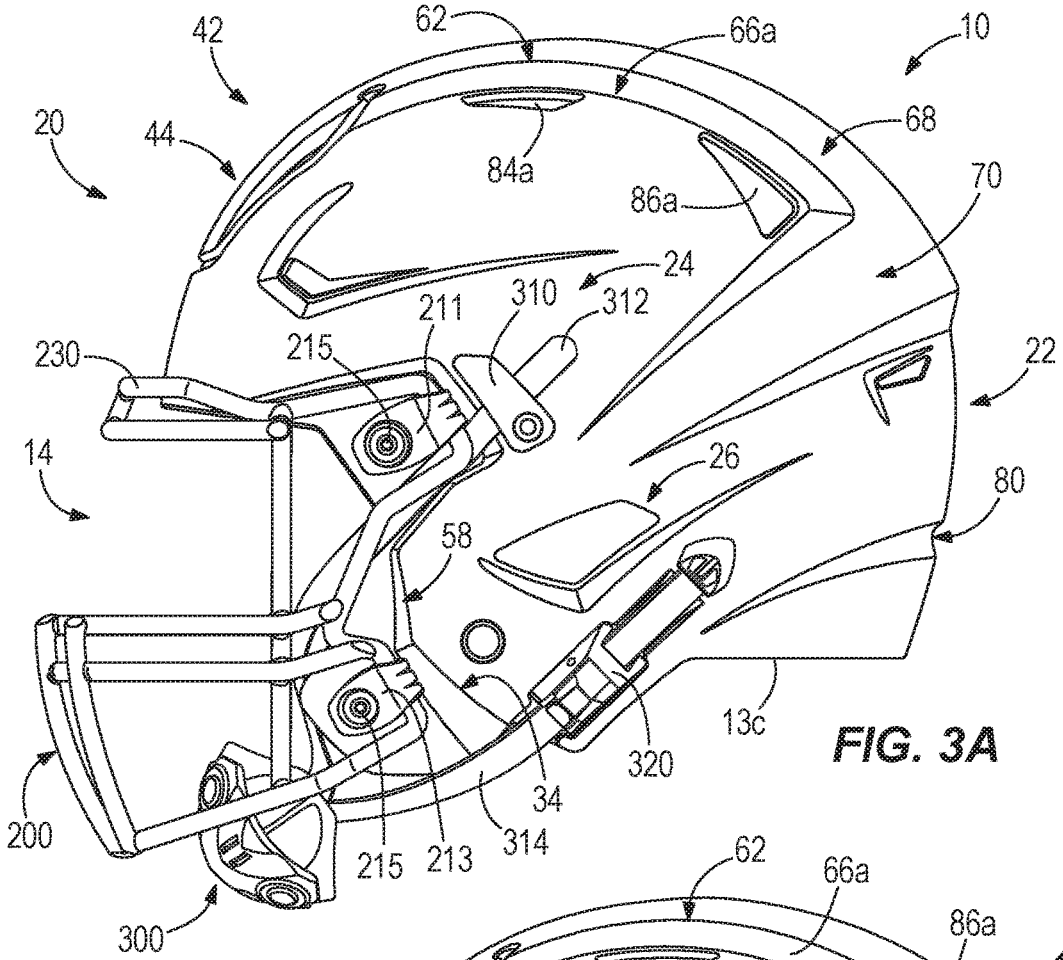
FIG. 3A is a left side view of the football helmet, showing a face guard and chin strap assembly connected to the helmet.
Figure 3B:
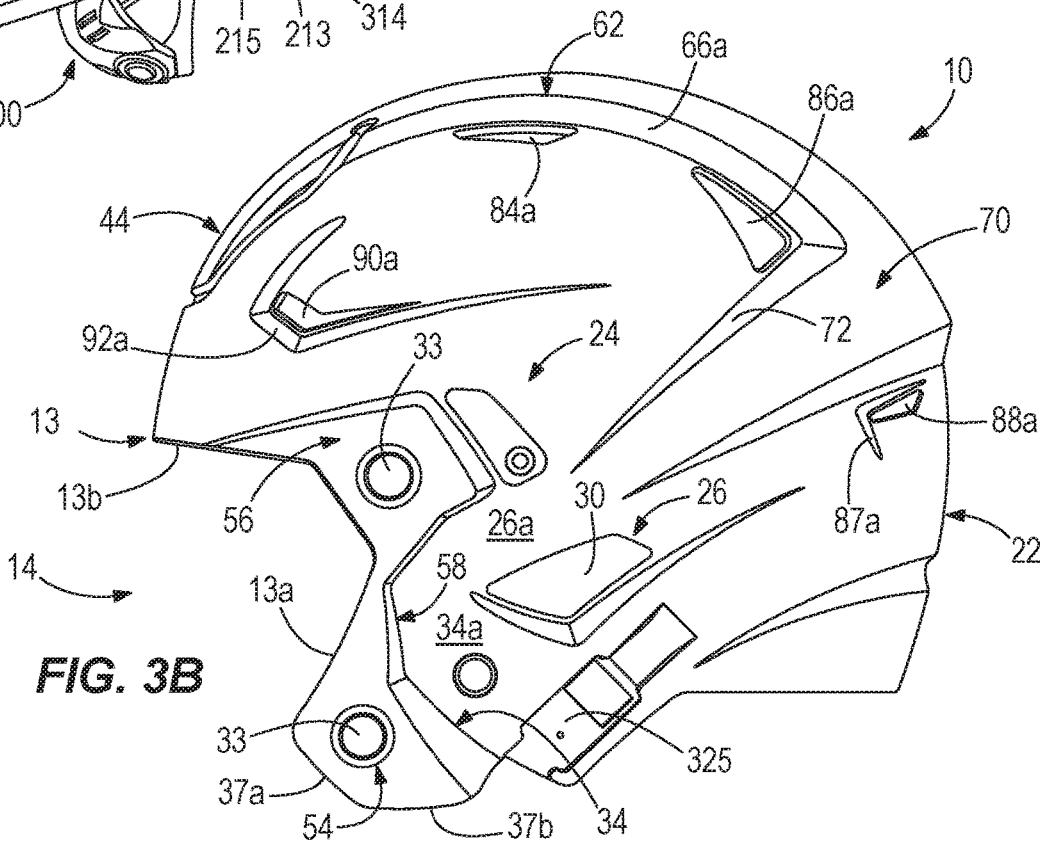
FIG. 3B is a left side view of the football helmet, omitting the face guard and chin strap assembly.
Figure 7:
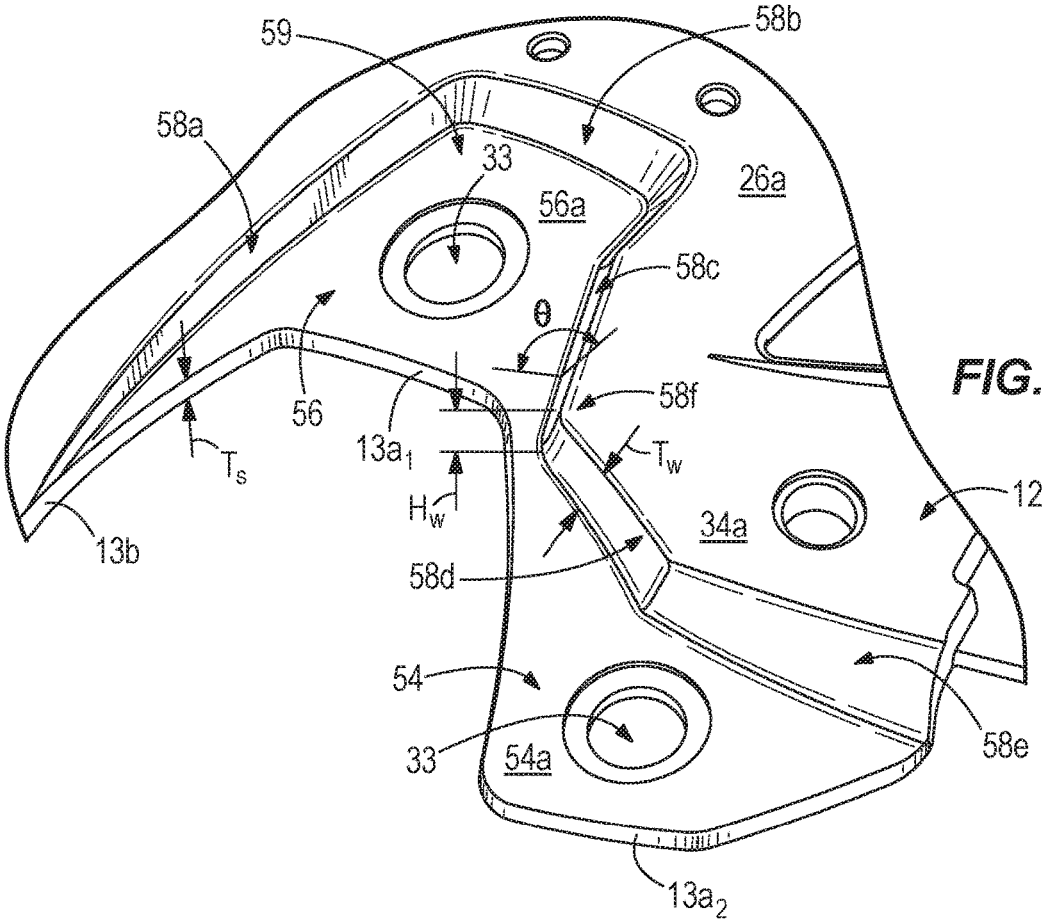
FIG. 7 is an enlarged perspective view of an outer surface of the shell and the recessed face guard mounting area of the football helmet.
Figure 9:
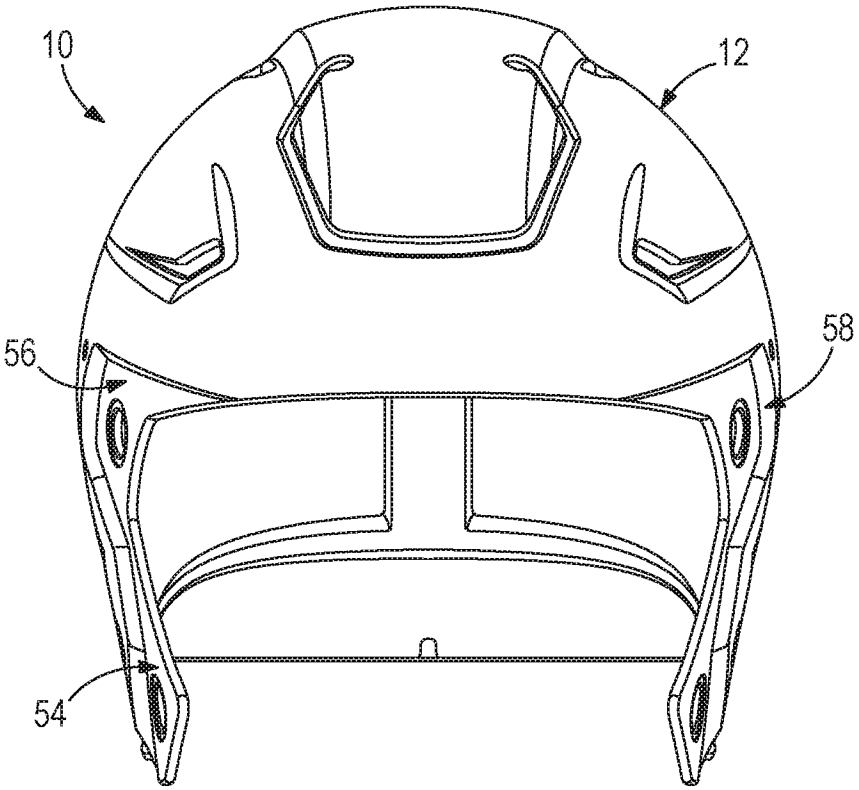
FIG. 9 is a front view of the football helmet.

As shown in FIGS. 3B, 7 and 9, the frontal opening 14 in the helmet 10 is defined by a frontal edge 13 of the shell 12 wherein the frontal edge 13 includes left and right peripheral frontal edges 13*a* and a central frontal edge 13*b* that extends horizontally between the opposed peripheral frontal edges 13*a* which are substantially vertically oriented. The shell 12 also includes a pair of jaw flaps 34, with each jaw flap 34 extending generally forwardly from a respective one of the ear flaps 26 for protection of the mandible area of the player P. The face guard mounting system 50 (see FIG. 1) includes at least one recessed mounting region that extends vertically along the peripheral frontal edges 13*a* of the helmet shell 12. In the illustrated configuration, each jaw flap 34 includes a first or lower recessed face guard attachment region 54 adjacent a lower extent 13*a*2 of the peripheral frontal edge 13*a*. A second or upper recessed face guard attachment region 56 is provided adjacent an upper extent 13*a*1 of the peripheral frontal edge 13*a*. The lower and upper recessed face guard attachment regions 54, 56 have a generally trapezoidal configuration. Each attachment region 54, 56 includes an aperture 33 that receives an elongated fastener 215 extending through the face guard connector 211, 213 to removably secure the face guard 200 to the shell 12. As explained below, the lower face guard attachment region 54 is recessed inward compared to the adjacent outer surface 34*a* of the jaw flap 34, and the upper face guard attachment region 56 is recessed inward compared to the adjacent outer surface 26*a* of the ear flap 26.

As shown in FIGS. 3B, 7 and 9, there is a sloped or angled transition wall 58 extending inward (towards the head of player P when the helmet 10 is worn) from the ear flap outer surface 26*a* and the jaw flap outer surface 34*a* to the recessed attachment regions 54, 56. Preferably, the transition wall 58 is oriented at an angle Θ greater than 90 degrees and less than 150 degrees (see FIG. 7). Due to this arrangement, the outer surface 54*a* of the lower recessed region 54 is recessed inward from the jaw flap outer surface 34 and the outer surface 56*a* of the upper recessed region 56 is recessed inward from the ear flap outer surface 26*a*. The transition wall 58 extends rearward at a slight incline from the central frontal edge 13*b* and then downward and in close proximity to the peripheral edge 13*a*, then away from a frontal jaw flap edge 37*a*, and then downward to a lower jaw flap edge 37*b*. Accordingly, the transition wall 58 has multiple segments including a first lateral segment 58*a*, a first downward segment 58*b*, a second downward segment 58*c*, a third downward segment 58*d* and a fourth downward segment 58*e* that leads to the lower jaw flap edge 37*b*.Referring to FIG. 7, an extent of the first lateral segment 58*a*, the first downward segment 58*b*, and an extent of the second downward segment 58*c* form a U-shaped area 59. Referring to FIG. 7, the transition wall 58 extending from the ear flap 26 to the jaw flap 34 and the recessed face guard attachment regions 54, 56 collectively form a corrugation in the helmet shell 12, and thus do not involve either the removal of material from the shell 12 or a reduction in the wall thickness $T_S$ of the shell 12. Thus the shell's wall thickness $T_S$ remains substantially constant across the majority of these regions of the shell 12.

Figure 8:
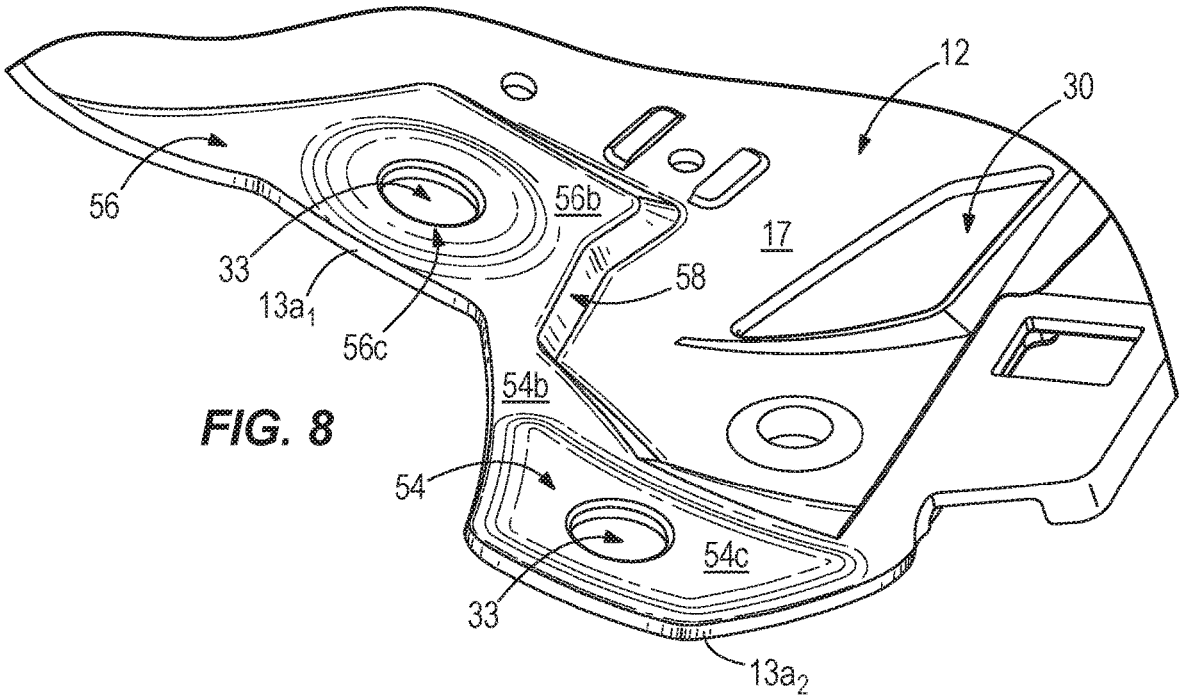
FIG. 8 is an enlarged perspective view of an inner surface of the shell and the recessed face guard mounting area of the football helmet.

FIG. 8 shows the features of the inner shell surface 17 of the shell 12 including the ear opening 30, the recessed face guard attachment regions 54, 56 and the transition wall 58. Because the lower and upper recessed face guard attachment regions 54, 56 are recessed from the outer surface shell surface 16, these features have a raised or embossed appearance compared to the inner shell surface 17. Thus, these features are present and visually apparent in both the outer shell surface 16 and the inner shell surface 17. Furthermore, the inner surface 54*b* of the lower attachment region 54 and the inner surface 56*b* of the upper attachment region 56 are recessed inward of the inner shell surface 17. The upper recessed attachment region 56 also includes a substantially circular boss 56*c* formed on the inner shell surface 17 around the aperture 33. Similarly, the lower recessed attachment region 54 includes a generally trapezoidal boss 54*c* formed on the inner shell surface 17 around the aperture 33.

Referring to FIG. 7, the transition wall 58 is stepped inward to form the corrugation in the shell 12 discussed above. At the apex 58*f* between the second and third downward segments 58*c,d*, the transition wall 58 has a height $H_W$ of at least 0.125 inch, preferably at least 0.15 inch and most preferably between 0.15 inch and less than 0.275 inch. At the apex 58*f*, the transition wall 58 has a thickness $T_W$ along its sloped surface of at least 0.25 inch, preferably at least 0.275 inch and most preferably at least 0.3 inch and less than 0.5 inch. At a midpoint of the fourth downward segment 58*e* that leads to the lower jaw flap edge 37*b*, the transition wall 58 has a reduced slope and thus a thickness $T_W$ along its sloped surface of at least 0.3 inch, preferably at least 0.4 inch and most preferably at least 0.5 inch and less than 0.75 inch. The shell 12 has a nominal wall thickness $T_S$ of 0.125 inch±0.005 inch. These dimensions of the transition wall 58 and shell 12 ensure that the structural rigidity and flexural modulus of the helmet 10 are sufficiently high to enable the helmet 10 to withstand multiple impacts and impact forces, including those resulting from frontal impacts and slightly off-center frontal impacts.

Figure 10:
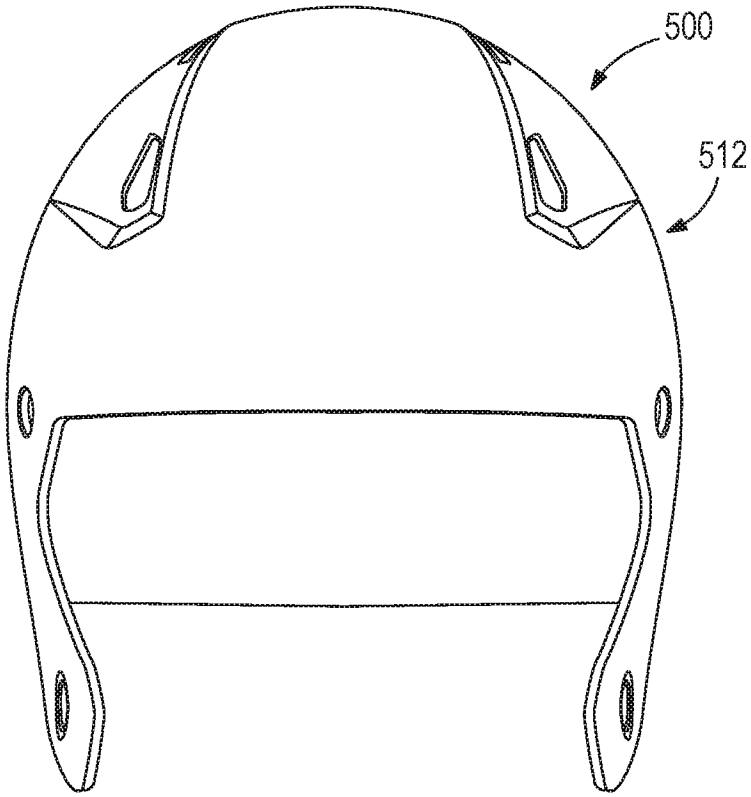
FIG. 10 is a front view of a prior art football helmet.
Figure 12A:
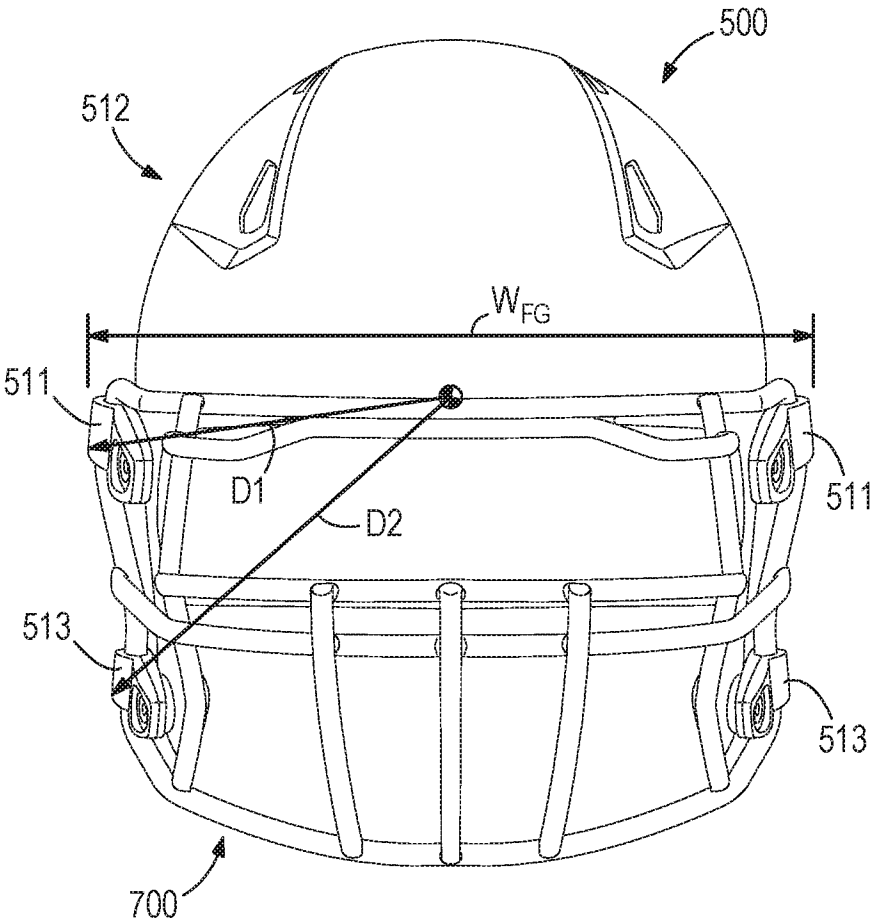
FIG. 12A is a front view of a prior art football helmet, including a face guard connected to the helmet shell.
Figure 11A:
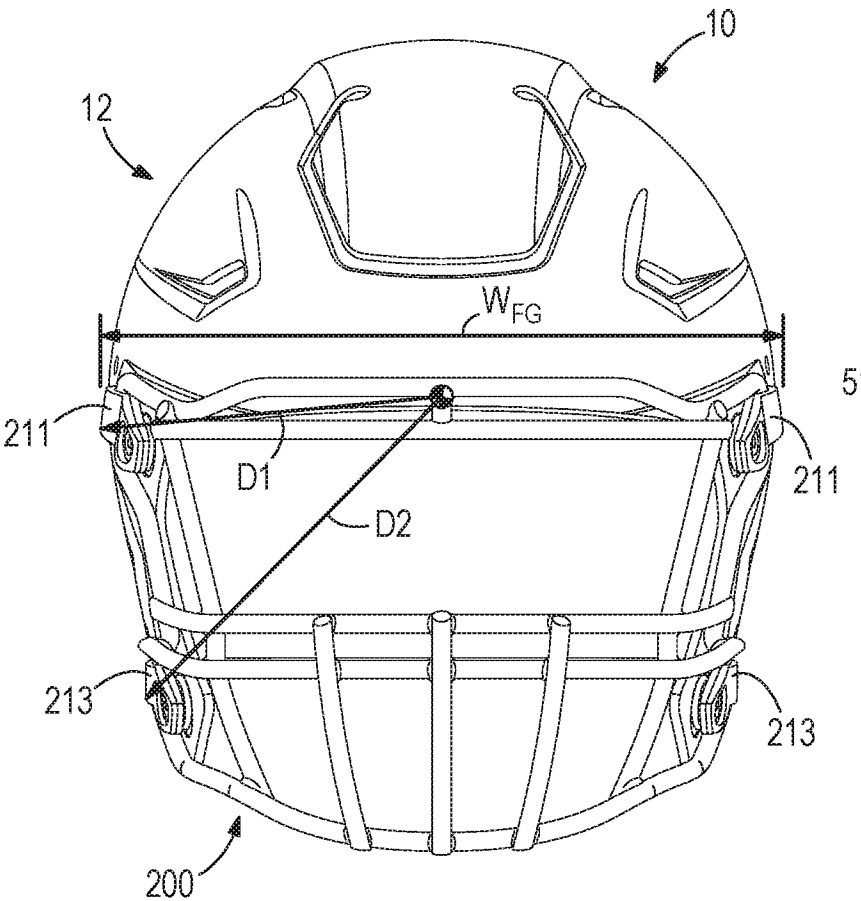
FIG. 11A is a front view of the football helmet, including the face guard connected to the helmet shell.

FIGS. 9 and 10 provide a side-by-side view of the shell 12 of the inventive helmet 10 and the shell 512 of a prior art helmet 500 that lacks the lower and upper recessed face guard attachment region 54, 56 and a number of other structural features of the helmet 10. The shell 12 and shell 512 have substantially the same outer dimensions, for example outer width and overall height. Although not shown with the helmet 500 of FIG. 10, some prior art football helmets include additional material added to the shell in the area surrounding the frontal opening and along the peripheral frontal edges and a central frontal edge that define the front opening. FIGS. 11A and 12A provide a side-by-side view of the inventive helmet 10, including the face guard 200 secured to the helmet 10 by the connectors 211, 213, and the prior art helmet 500, including face guard 700 secured to helmet 500 by the connectors 511, 513. For reference purposes, the prior art helmet 500 closely corresponds to the Riddell 360® football helmet, which was designed and currently marketed by Riddell, Inc., the Assignee of the present Application. The helmet 10 and the helmet 500 depicted in FIGS. 11 and 12 are adult size large models, which correspond to a hat size of 7-7.5 and a head circumference of 22-23.5 inches. These two Figures show the low-profile mounting arrangement of the face guard 200 to the helmet 10 as provided by the lower and upper recessed face guard attachment region 54, 56. The distance between the upper face guard connectors 211, 511 represents the face guard width $W_{FG}$. Due to the lower and upper recessed face guard attachment region 54, 56 and the resulting low-profile mounting of the face guard 200, the face guard width $W_{FG}$ of the helmet 10 is considerably less than the face guard width $W_{FG}$ of the prior art helmet 500, which lacks the low-profile mounting of the face guard 700. In addition, the distance D1 between the center of mass and the upper face guard connector 211 for the helmet 10 is less than the distance D1 between the center of mass and the upper face guard connector 511 for the prior art helmet 500. Similarly, the distance D2 between the center of mass and the lower face guard connector 213 for the helmet 10 is less than the distance D2 between the center of mass and the lower face guard connector 513 for the prior art helmet 500.

Figure 12B:
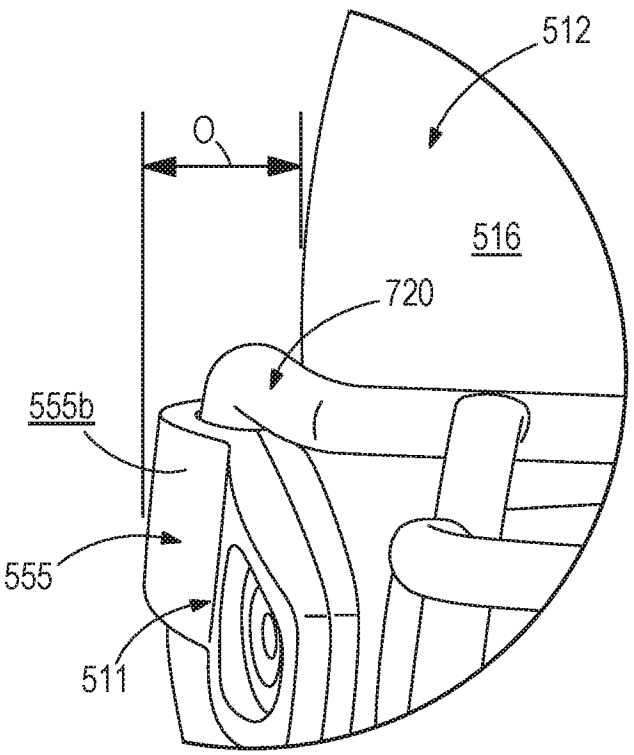
FIG. 12B is an enlarged view of the prior art football helmet, showing the offset distance between the outer shell surface and the outer bracket surface.
Figure 11B:
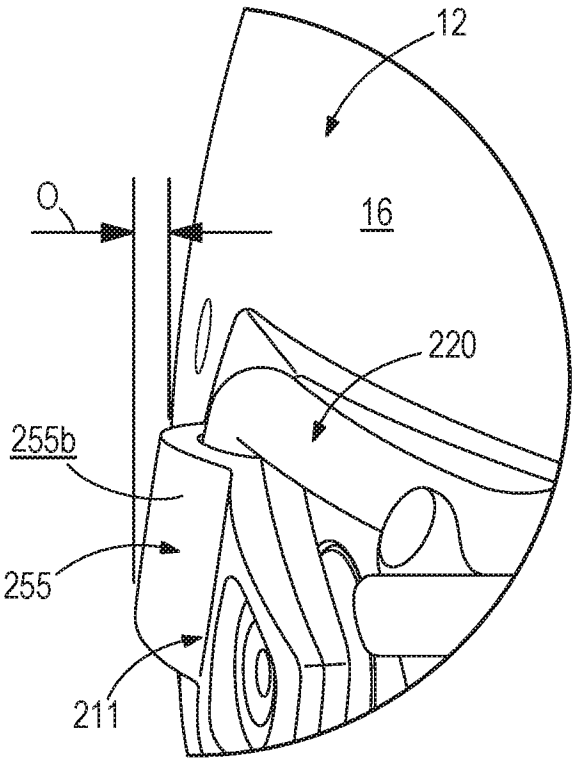
FIG. 11B is an enlarged view of the football helmet, showing the offset distance between the outer shell surface and the outer bracket surface.
Figure 13:
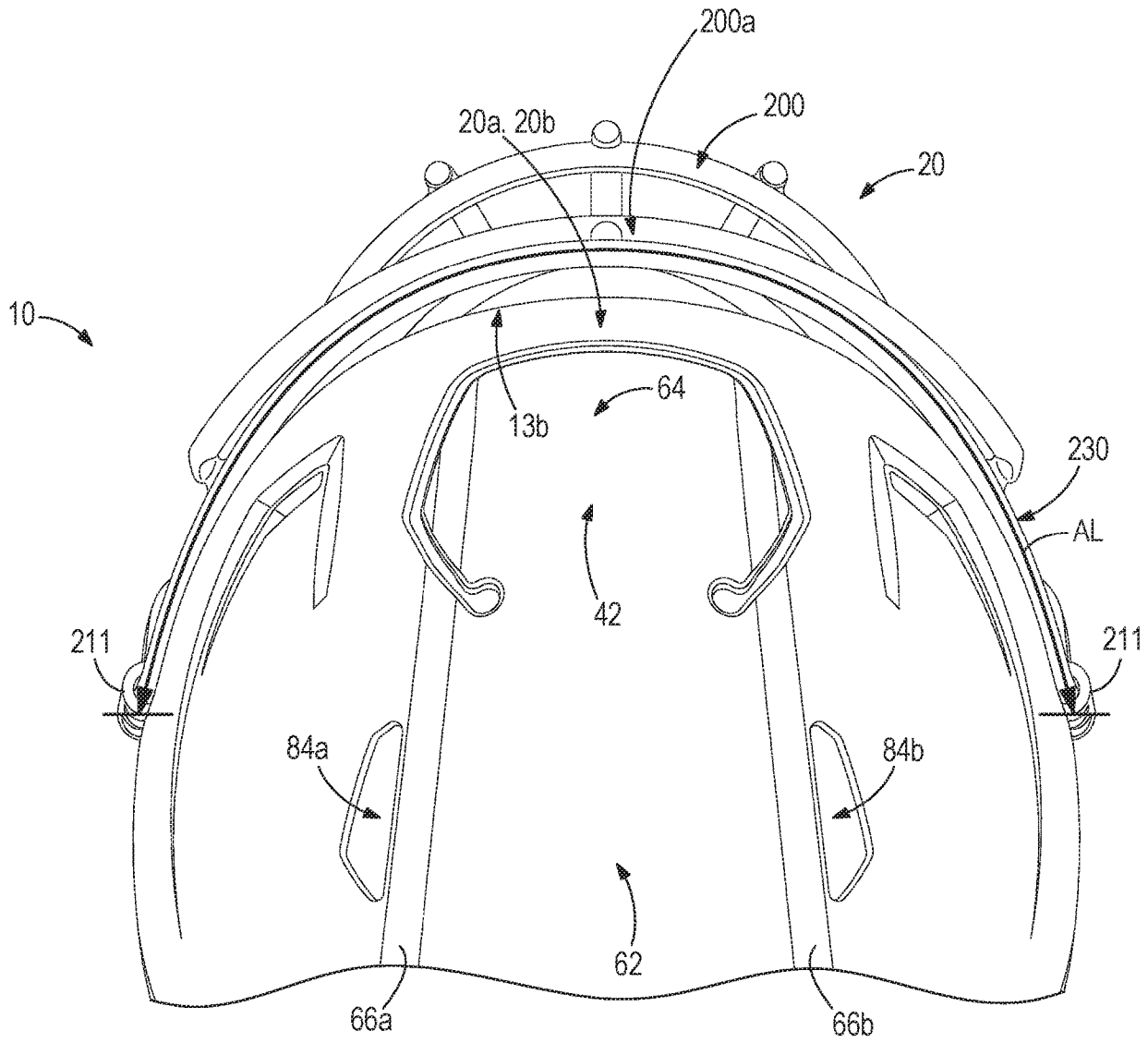
FIG. 13 is a partial top view of the football helmet.

FIG. 11B is an enlarged view of the football helmet 10 showing an offset distance o between the outer shell surface 16 and the outermost surface 255*b* of the terminal end 255 of the upper connector right bracket 211. FIG. 12B is an enlarged view of the football helmet 510 showing an offset distance o between the outer shell surface 516 and the outermost surface 555*b* of the terminal end 555 of the upper connector right bracket 511. As shown in FIGS. 11B and 12B and due to the low-profile connection of the face guard 200 to the helmet 10, the offset o for the helmet 10 is considerably less than the offset o for the prior art helmet 510. In the embodiment of the Figures, the offset o of the helmet 10 is less than 0.5 inch, preferably less than 0.45 inch and most preferably is 0.4 inch. Furthermore, the upper peripheral face guard portion 220 is closer to the outer shell surface 16 of the helmet 10 (see FIG. 11B) compared to the distance between the upper peripheral face guard portion 720 and the outer shell surface 516 of the helmet 510 (see FIG. 12B). Referring to FIG. 13, there is an arc length AL extending along the uppermost bar 230 of the face guard 200 of the helmet 10. The uppermost bar 230 extends along the front shell portion 20 but does not contact the lower front shell portion 20*a*. Because of the lower and upper recessed face guard attachment regions 54, 56 and the resulting low-profile connection of the face guard 200 to the helmet, the arc length AL is less than the AL in the prior art helmet 500 (not shown). Additionally, FIG. 13 shows that the helmet 10 lacks a structure that is coupled to an upper central portion 200*a* of the face guard 200 and a front and central portion 20*a* of the shell 20.

Figure 2:
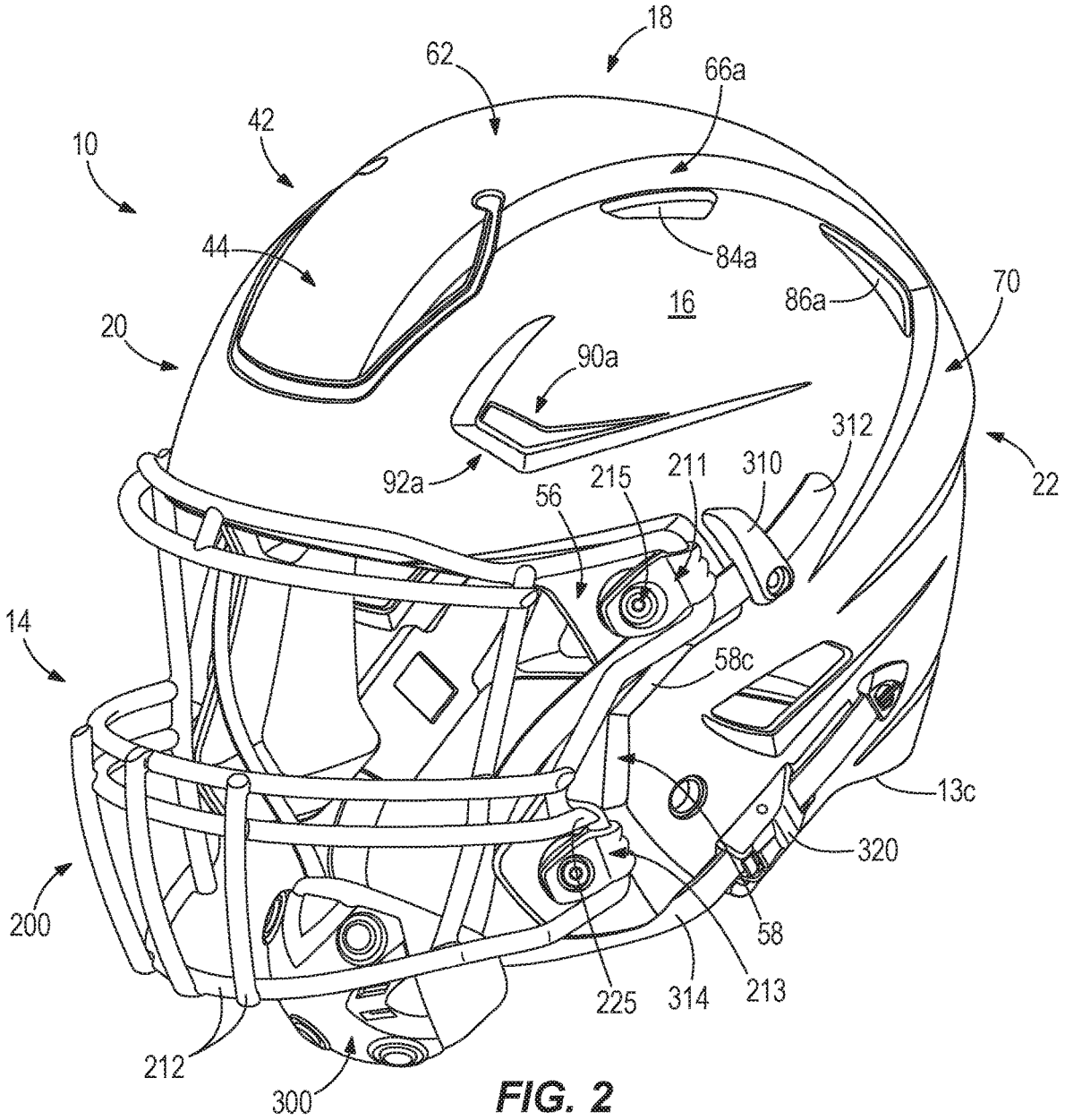
FIG. 2 is a perspective view of the football helmet.
Figure 6:
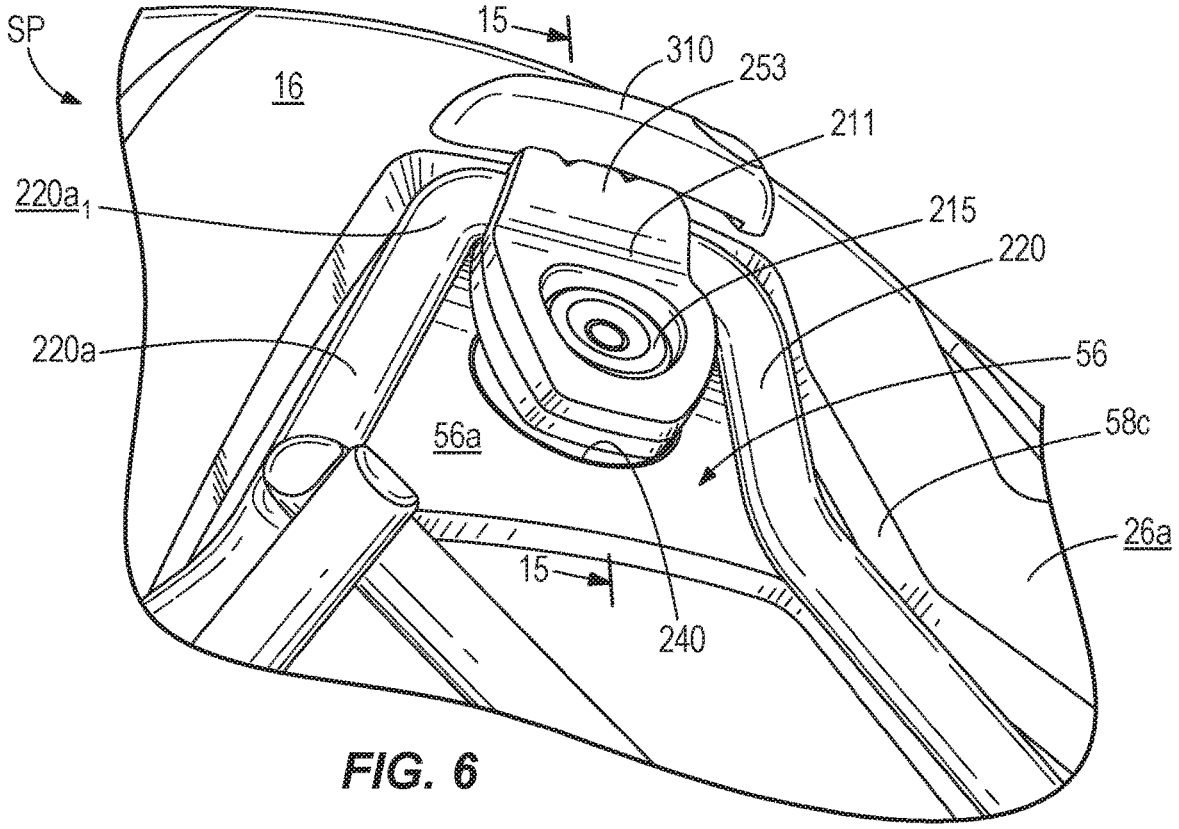
FIG. 6 is an enlarged perspective view of a recessed face guard mounting area of the football helmet, showing the face guard connected to the helmet shell.
Figure 15:
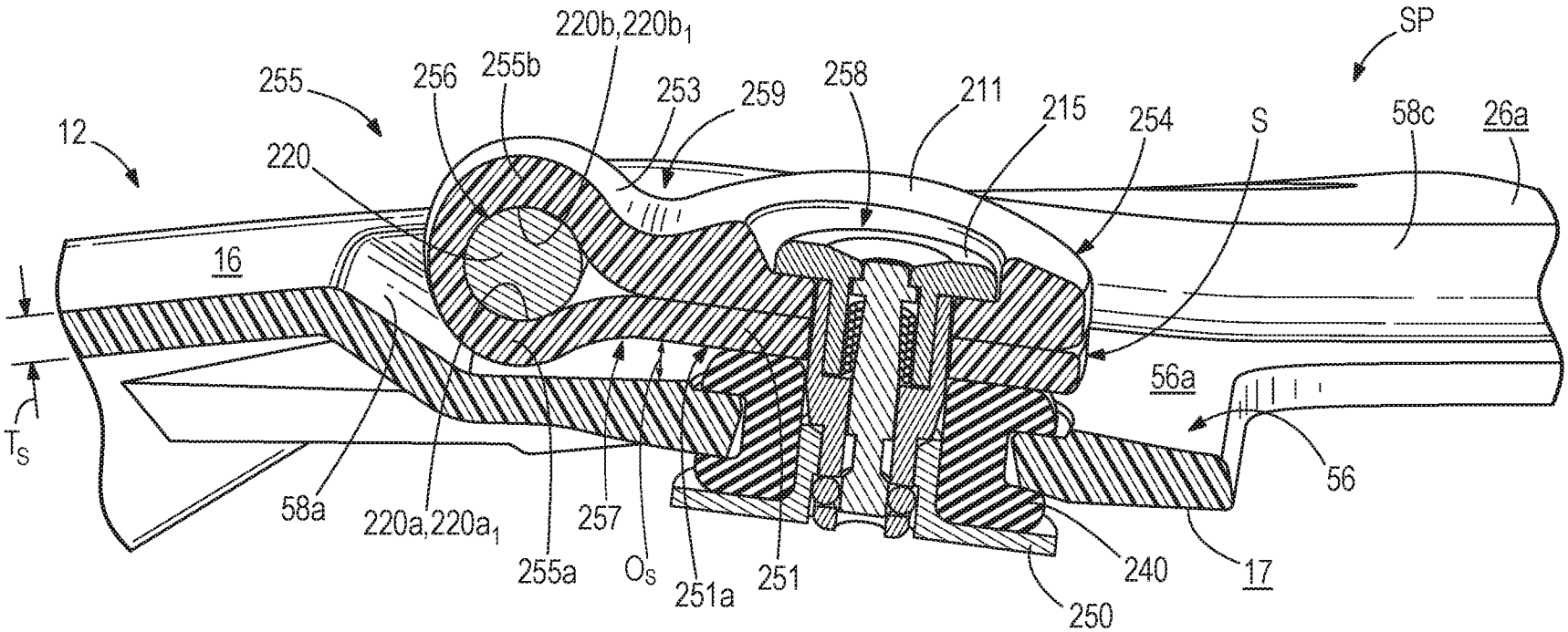
FIG. 15 is a partial cross-section of the football helmet taken along line 15-15 of FIG. 6, showing an extent of the face guard connected to the recessed mounting area of the helmet.

Referring to FIG. 2, when the face guard 200 is secured to the shell 12, a lower peripheral portion 225 of the face guard 200 resides within the periphery of the lower recessed attachment region 54, which is bounded by the transition wall 58. Referring to FIGS. 6 and 15, when the face guard 200 is secured to the shell 12, an upper peripheral portion 220 of the face guard 200 having a U-shaped configuration resides within the periphery of the upper recessed attachment region 56, which is also bounded by the transition wall 58. The elongated fastener 215 is a multiple component, quick-release fastener that is described in co-pending U.S. patent application Ser. No. 12/082,920 and extends through the connector brackets 211, 213. A grommet 240 is positioned within the aperture 33 in the upper attachment region 56 wherein the fastener 215 and a retainer 250 extend through the grommet 240. The connector bracket 211, 213 has a clam shell configuration and includes an inner segment 251 and an outer segment 253 that converge to form a bulbous terminal end 255. The terminal end 255 defines a receiver 256 that envelops or receives an extent of the peripheral portion 220 of the face guard 200. Adjacent the peripheral portion 220, the inner and outer segments 251, 253 include a recess 257, 259 leading to the aperture 258 that receives the fastener 215 in the secured position SP of FIGS. 6 and 15. The inner and outer segments 251, 253 meet at a seam S that extends longitudinally from a leading end 254 to the receiver 256. In the secured position SP, an inner portion 255*a* of the terminal end 255 and the inner bracket segment 251 reside inward of the outer shell surface 16, including the outer ear flap surface 26*a*, while an outer portion 255*b* of the terminal end 255 resides outward of the outer shell surface 16. Also, in the secured position SP of FIG. 15, an inner surface 251*a* of the inner bracket segment 251 is offset a distance "Os " from the outer surface of the recessed face guard attachment region 56*a*. Further, in the secured position SP of FIGS. 6 and 15, an inner surface 220*a*1 provided by an inner portion 220*a* of the peripheral face guard portion 220 both reside inward of the outer shell surface 16, including the outer ear flap surface 26*a*, while an outer surface 220*b*1 provided by outer portion 220*b* resides radially outward of the outer shell surface 16. These positional relationships are primarily due to the upper recessed attachment region 56 which, along with the lower recessed attachment region 54, provide the low-profile connection of the face guard 200 to the helmet shell 12.

Figure 14:
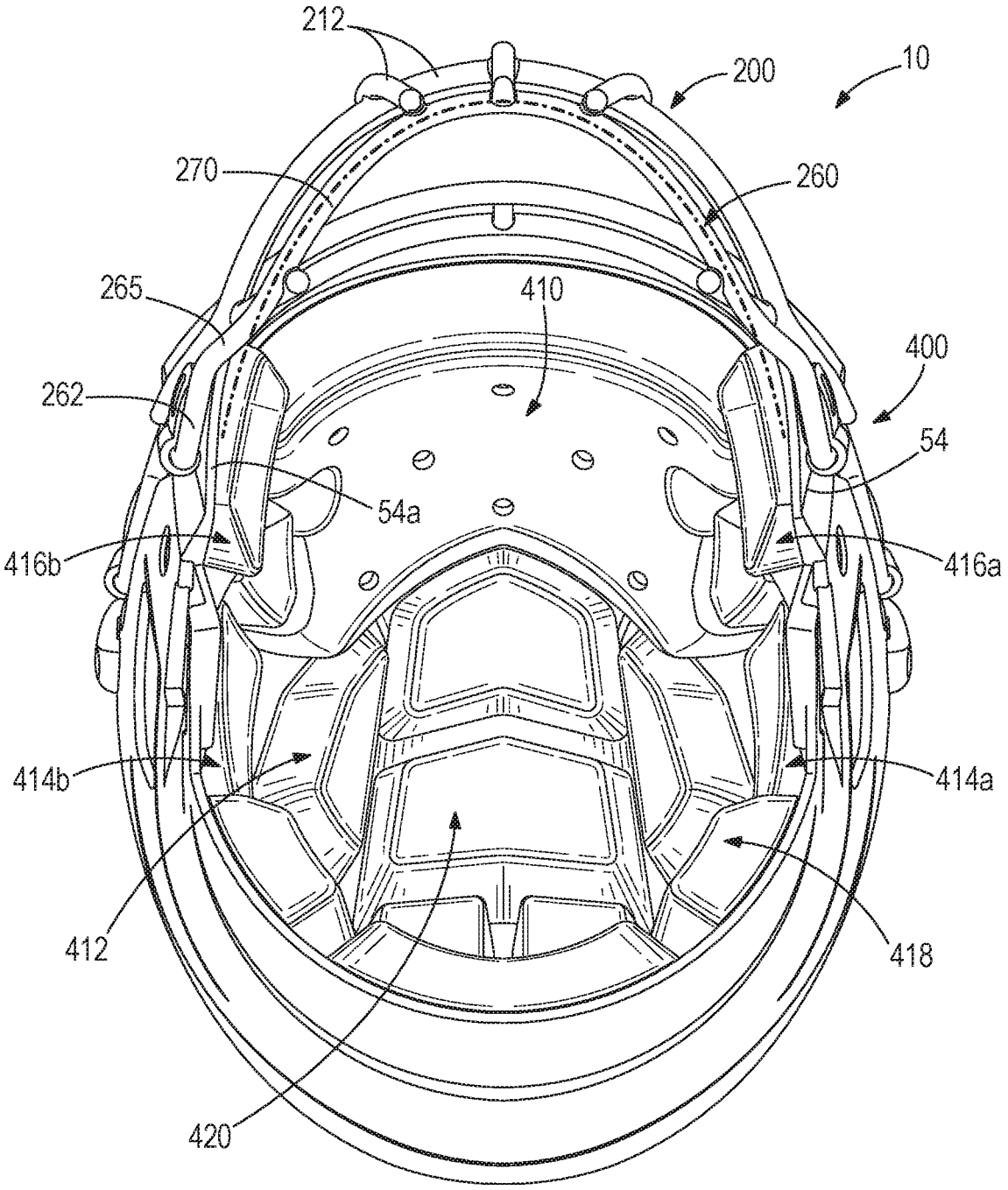
FIG. 14 is a bottom view of the football helmet, showing the face guard and an internal pad assembly.

Referring to FIG. 14, the face guard 200 has a lower bar 260 that has opposed substantially linear peripheral segments 262, substantially linear inward transition segments 265 and a curvilinear intermediate segment 270. The peripheral and transition segments 262, 265 combine to follow along the radius of curvature (shown in dotted lines) defined by the lower edge 37*b* of the jaw flap 54. The configuration of the lower bar 260, including its segments 262, 265 and 270, and the jaw flap 54 further ensure the low-profile mounting configuration of the face guard 200 to the shell 12. As shown in the Figures, the helmet 10 includes four distinct recessed regions—a pair of first or upper recessed attachment regions 56 and a pair of second or lower recessed attachment regions 54—and four distinct face guard connectors—a pair of first or upper connectors 211 and a pair of second or lower connectors 213—that collectively provide four connection points for the face guard 200 to the shell 12. This configuration renders unnecessary the need for a connection point along the lower front shell portion 20*a* for the upper bar of the face guard 200. In another embodiment, the helmet 10 is configured with either the upper recessed attachment regions 56 and connectors 211, or the lower recessed attachment regions 54 and connectors 213 along with a connection point on the front shell portion 20 along the central frontal edge 13*b*. This frontal connection point can have a recessed configuration consistent with the upper and lower recessed attachment regions 54, 56. This alternate configuration provides four face guard connection points, wherein at least two of the connection points feature a recessed attachment region.

As shown in FIG. 2, chin strap securement member 310 is positioned rearward of the upper face guard attachment region 56 and is configured to receive an upper strap member 312 of the chin strap assembly 300. A multi-adjustable chin strap securement member 320, which is positioned rearward of the lower face guard attachment region 54 and along a lower side shell edge 13*c*, is configured to receive a lower strap member 314 of the chin strap assembly 300. The multi-adjustable chin strap securement member 320 is received by a receptacle 325 (see FIG. 3B) formed in a lower portion of the shell 12. In the use position shown in FIGS. 1 and 3, the upper strap member 312 extends between the upper peripheral portion 220 of the face guard 200 and the upper attachment region 56. More specifically, the upper strap member 312 extends through a gap or clearance formed between the outer surface of the upper attachment region 56 and the inner surface of the upper peripheral face guard portion 220. The upper strap member 312 can engage the second downward segment 58*c* of the transition wall 58.

Figure 4:
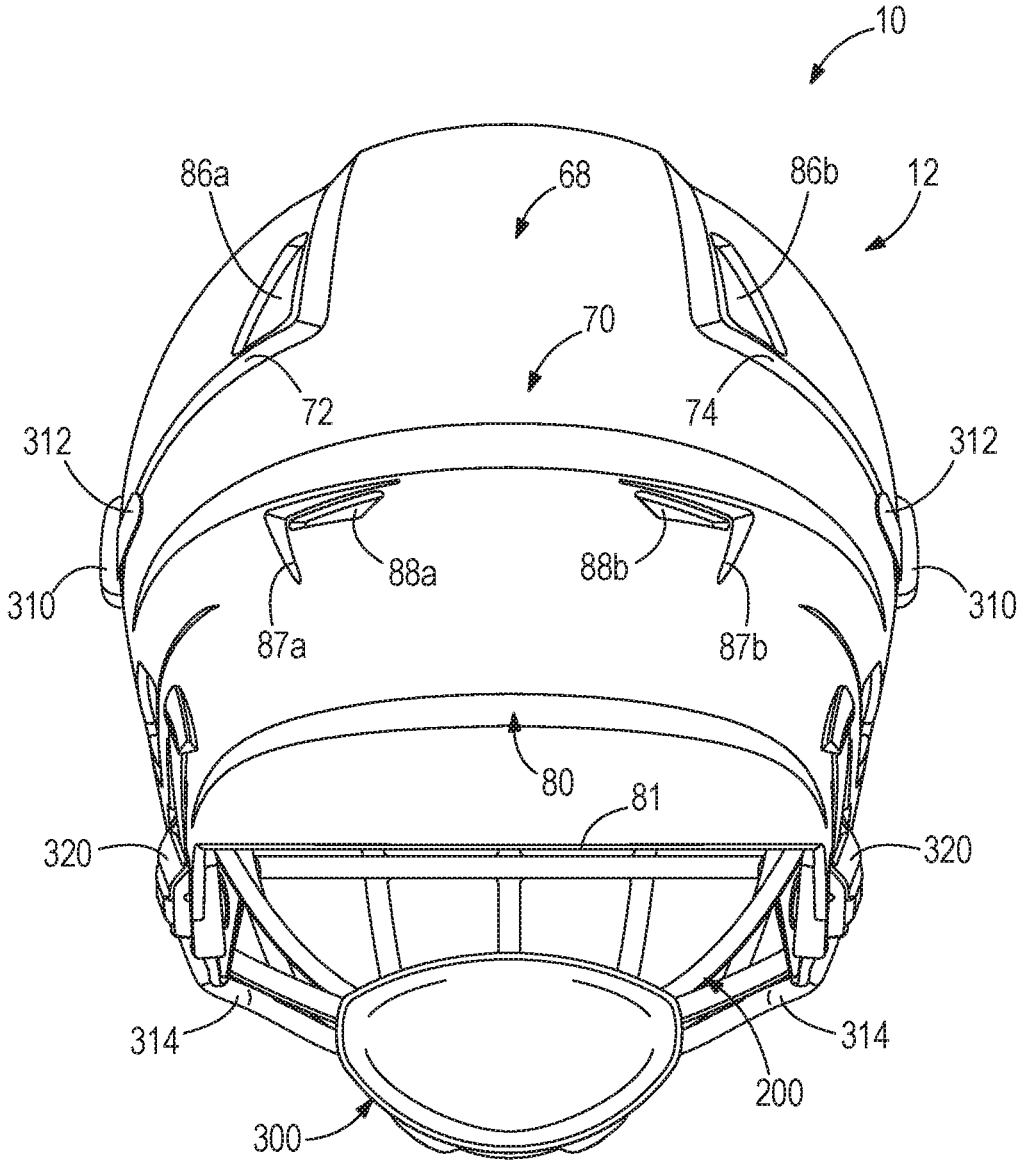
FIG. 4 is a rear view of the football helmet.
Figure 5:
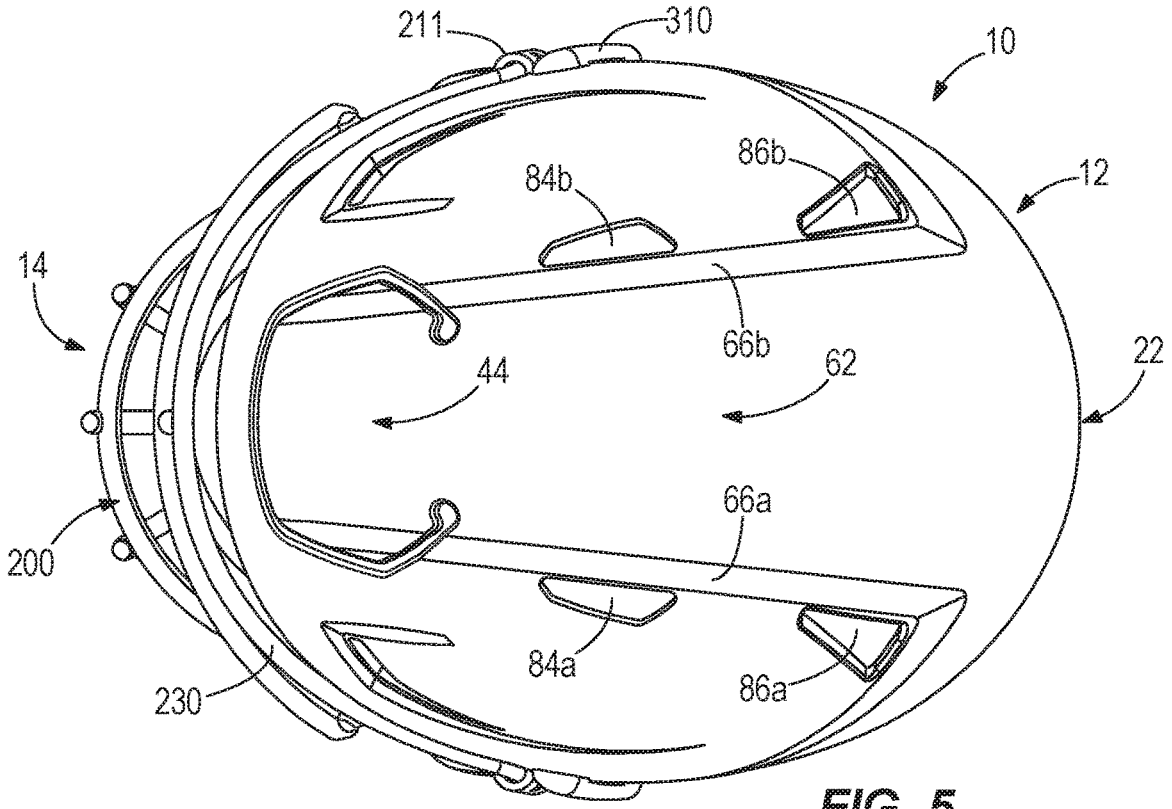
FIG. 5 is a top view of the football helmet.

The helmet 10 also includes a raised central band 62 that extends from the front shell portion 20 across the crown portion 18 to the rear shell portion 22. The band 62 is defined by a pair of substantially symmetric raised sidewalls or ridges 66*a*, 66*b* that extend upwardly at an angle from the outer shell surface 16. When viewed from the side, the sidewalls 66*a*, 66*b* define a curvilinear path, preferably continuous, as they extend across the crown portion 18 to the rear shell portion 22. As shown in FIG. 13, a front portion 64 of the band 62 is coincident with the impact attenuation member 42 and is positioned a distance above the central frontal edge 13*b*. Referring to FIGS. 4 and 5, the band 62 has a width that increases as the band 62 extends from the front shell portion 20 across the crown portion 18 to the rear shell portion 22. As shown in FIGS. 3, 4 and 7, a rear portion 68 of the band 62 is coincident with and merges with a rear raised band 70 that extends transversely between the left and right side portions 24 of the shell 12. Similar to the sidewalls 66*a*, 66*b*, the rear band sidewalls 72, 74 are sloped meaning they extend outwardly and upwardly at angle from the outer shell surface 16. Referring to FIG. 4, a lower channel 80 extends transversely below the raised rear band 70 and above a lower rear shell edge 81.

As shown in the Figures, the helmet 10 further includes numerous vent openings that are configured to facilitate air circulation within the helmet 10 when it is worn by the player P. A first pair of vent openings 84 are formed in the crown portion 18, wherein the left vent opening 84*a* is substantially adjacent the left sidewall 66*a* and the right vent opening 84*b* is substantially adjacent the right sidewall 66*b*. A second pair of vent openings 86 are formed in the rear shell portion 22, wherein the left vent opening 86*a* is substantially adjacent the left sidewall 66*a* and left band sidewall 72, and the right vent opening 86*b* is substantially adjacent the right sidewall 66*b* and right band sidewall 74. The left first and second vent openings 84*a*, 86*a* are substantially aligned along the left sidewall 66*a*, and the right first and second vent openings 84*a*, 86*a* are substantially aligned along the right sidewall 66*b*. A third pair of vent openings 88 are formed in the rear shell portion 22 below the rear raised band 70, wherein the left vent opening 88*a* is positioned adjacent a left ridge 87*a* and the right vent opening 88*b* is positioned adjacent a right ridge 87*b*. A fourth pair of vent openings 90 are formed in the front shell portion 20, wherein the left vent opening 90*a* is positioned adjacent a left frontal ridge 92*a* and the right vent opening 90*b* is positioned adjacent a right frontal ridge 92*b*. The frontal ridges 92*a,b* are located between the front shell portion 20 and the side portion 24 and thus generally overlie the temple region of the player P when the helmet 10 is worn. The first, second, third and fourth vent openings 84*a,b*, 86*a,b*, 88*a,b* and 90*a,b* are cooperatively positioned with voids in the internal padding assembly 400 to facilitate the flow of air through the helmet 10.

As shown in FIG. 14, the helmet 10 includes an internal padding assembly 400 with a front pad 410 that structurally and functionally interacts with the impact attenuation member 42. As such, the engineered impact attenuation system comprises both the cantilevered segment 44 and the front pad 410. The internal padding assembly 400 also comprises a crown pad assembly 412, left and right ear flap pad assemblies 414*a,b*, left and right jaw flap pad assemblies 416*a,b*, and rear pad assembly 418. The internal padding assembly 400 also includes a relatively thin, padded overliner 420 that is positioned against the player's P head when the helmet 10 is worn. It is understood that the overliner 420, the crown pad assembly 412, the left and right ear flap pad assemblies 414*a,b*, the left and right jaw flap pad assemblies 416*a,b*, and the rear pad assembly 418 can include a number of distinct pad members formed from one or more energy absorbing materials.

It is to be understood that the invention is not limited to the exact details of construction, operation, exact materials or embodiments shown and described, as obvious modifications and equivalents will be apparent to one skilled in the art; for example, the entire cantilever strap could be provided with a shock absorbing pad disposed upon its lower surface. Accordingly, the invention is therefore to be limited only by the scope of the appended claims. While the specific embodiments have been illustrated and described, numerous modifications come to mind without significantly departing from the spirit of the invention, and the scope of protection is only limited by the scope of the accompanying Claims.

What is claimed is:

1. A football helmet having a low-profile face guard mounting configuration, the helmet comprising:

a one-piece shell including:

a crown portion defining an upper region of the shell;

a front portion extending forwardly and downwardly from the crown portion;

left and right side portions extending downwardly and laterally from the crown portion, wherein the left and right side portions include an ear flap configured to generally overlie an ear region of a wearer of the helmet, wherein the front portion and the left and right side portions collectively define a frontal opening in the shell, wherein the frontal opening includes opposed peripheral frontal edges;

upper recessed face guard attachment regions, wherein each region extends along an upper extent of a respective one of the opposed peripheral frontal edges, wherein each upper recessed face guard attachment region resides inward of an adjacent outer surface of the shell and includes an aperture; and a face guard having a plurality of intersecting bars, the face guard having upper peripheral mounting portions arranged in an opposed positional relationship;

upper connector brackets configured to be received by the upper recessed face guard attachment regions;

wherein in a secured position, the upper peripheral mounting portions of the face guard are secured to the upper recessed face guard attachment regions by an elongated fastener that extends through both a respective one of the upper connector brackets and the aperture formed in the upper recessed face guard attachment region to provide the low-profile face guard mounting configuration;

wherein in the secured position, (i) an inner surface of said upper peripheral mounting portions resides inward of the adjacent outer shell surface, (ii) an exterior surface of said upper peripheral mounting portions resides external to the adjacent outer shell surface, and (iii) an inner surface of the upper connector brackets resides inward of the adjacent outer shell surface.

2. The football helmet of claim 1, wherein the shell includes a substantially horizontal frontal edge that extends between the opposed peripheral frontal edges, and wherein each upper recessed face guard attachment region commences at said horizontal frontal edge and extends downward along the respective one of the peripheral frontal edges.

3. The football helmet of claim 2, wherein said horizontal frontal edge includes opposed end portions and an intermediate portion extending between the end portions, and wherein the upper recessed face guard attachment regions terminate at an end portion of said horizontal frontal edge and does not extend along the intermediate portion of said horizontal frontal edge.

4. The football helmet of claim 1, the shell further including a lower recessed face guard attachment region extending along a lower extent of each opposed peripheral frontal edge.

5. The football helmet of claim 4, wherein the lower recessed face guard attachment region is defined by a lower angled transition wall formed in the shell, wherein the lower angled transition wall extends between the lower recessed face guard attachment region and the ear flap.

6. The football helmet of claim 4, wherein the face guard has two opposed lower peripheral portions, wherein each of the lower peripheral portions are secured to the lower recessed face guard attachment region by a lower connector bracket affixed to the lower recessed face guard attachment region.

7. The football helmet of claim 6, further comprising an elongated fastener that extends through the lower connector bracket and the lower recessed face guard attachment region.

8. The football helmet of claim 1, wherein the shell includes an ear opening formed in the ear flap, each of the upper recessed face guard attachment regions being positioned above the ear opening.

9. The football helmet of claim 1, wherein each of the upper recessed face guard attachment regions form a corresponding embossed structure as part of the inner surface of the shell.

10. The football helmet of claim 9, wherein the shell has a thickness that remains substantially constant across each of the upper recessed face guard attachment regions and the ear flap.

11. The football helmet of claim 1, wherein each of the upper recessed face guard attachment regions is defined by an upper angled transition wall formed in the shell, wherein the upper angled transition wall extends between the upper recessed face guard attachment region and the ear flap, and wherein one of the upper connector brackets is positioned between the upper angled transition wall and one of the peripheral frontal edges of the shell.

12. The football helmet of claim 11, wherein each of the upper recessed face guard attachment regions and the upper angled transition wall form a corresponding embossed structure as part of the inner surface of the shell.

13. The football helmet of claim 11, wherein the shell has a thickness that remains substantially constant across each of the upper angled transition wall, the upper recessed face guard attachment region and the ear flap.

14. The football helmet of claim 11, wherein the upper angled transition wall has a plurality of segments that provide the upper recessed face guard attachment region with a substantially rectangular configuration.

15. The football helmet of claim 13, wherein the upper angled transition wall has a height of at least 0.125 inch to ensure that the upper recessed face guard attachment region provides the low-profile face guard mounting configuration in the secured position.

16. A football helmet having a low-profile face guard mounting configuration, the helmet comprising:

a one-piece shell including:

a crown portion defining an upper region of the shell;

a front portion extending forwardly and downwardly from the crown portion;

left and right side portions extending downwardly and laterally from the crown portion and include a non-circular ear opening, said front portion and said left and right side portions collectively define a frontal opening in the shell;

a recessed face guard attachment region that resides inward of an adjacent first portion of an outer shell surface, said recessed face guard attachment region forming an embossed structure as part of an inner shell surface;

a face guard having a plurality of intersecting bars, the face guard having an upper peripheral mounting portion;

a connector bracket configured to receive an extent of the upper peripheral mounting portion of the face guard and releasably secure the upper peripheral mounting portion of the face guard to the recessed face guard attachment region in a secured position; and wherein in the secured position: (i) an exterior surface of said upper peripheral mounting portion of the face guard resides external to the adjacent first portion of the outer shell surface, (ii) at least a first extent of an inner surface of the connector bracket reside inward of the adjacent first portion of the outer shell surface, and (iii) a second extent of the inner surface of the connector bracket is offset a distance from an outer surface of the recessed face guard attachment region.

17. The football helmet of claim 16, wherein the connector bracket is positioned at an angle relative to the recessed face guard attachment region, whereby a rear portion of the connector bracket resides outward of the adjacent first portion of the outer shell surface.

18. The football helmet of claim 16, wherein the shell has a thickness that remains constant across the recessed face guard attachment region and the adjacent first portion of the outer shell surface.

19. The football helmet of claim 16, wherein a shell thickness at a point in the recessed face guard attachment region is at least 0.12 inch.

20. The football helmet of claim 16, further comprising a second connector bracket that is positioned below the connector bracket and wherein the football helmet lacks a structure that is coupled to an upper centeral portion of the face guard and a central portion of the front portion of the shell.

21. The football helmet of claim 16, wherein at least an extent of the recessed face guard attachment region is positioned above the non-circular ear opening.

22. A football helmet having a low-profile face guard mounting configuration, the helmet comprising:

a one-piece shell including:

a crown portion defining an upper region of the shell;

a front portion extending forwadrly and downwardly from the crown portion;

left and right side portions extending downwardly and laterally from the crown portion and include a non-circular ear opening, said front portion and said left and right side portions collectively define a frontal opening in the shell;

a recessed face guard attachment region that resides inward of an adjacent first portion of an outer shell surface, wherein an extent of the recessed face guard attachment region is defined by an arrangement of three linear wall segments that are formed in the shell and define a U-shaped area;

a face guard having a plurality of intersecting bars, the face guard having an upper peripheral mounting portion;

a connector bracket configured to receive an extent of the upper peripheral mounting portion of the face guard and releasably secure ther upper peripheral mounting portion of the face guard to the recessed face guard attachment region in a secured position; and wherein in the second secured position: (i) an exterior surface of said upper peripheral mounting portion of the face guard resides external to the adjacent first portion of the outer shell surface, (ii) at least a first extent of an inner surface of the connector bracket reside inward of the adjacent first portion of the outer shell surface, and (iii) a second extent of the inner surface of the connector bracket is offset a distance from an outer surface of the recessed face guard attachment region.

23. The football helmet of claim 22, wherein the three linear wall segments include a first lateral segment and a first downward segment, and wherein a height of the first lateral segment is reduced as the first lateral segment extends from the first downward segment toward the frontal opening in the shell.

24. The football helmet of claim 22, wherein one point of the three linear wall segments has a height that is at least 0.15 inch.

25. The football helmet of claim 22, wherein the connector bracket is positioned at an angle relative to the recessed face guard attachment region, whereby a rear portion of the connector bracket resides outward of the adjacent first portion of the outer shell surface.

26. The football helmet of claim 22, wherein the shell has a thickness that remains constant across the recessed face guard attachment region and the adjacent first portion of the outer shell surface.

27. The football helmet of claim 22, wherein a shell thickness at a point in the recessed face guard attachment region is at least 0.125 inch.

* * * * *